US010704808B2

(12) United States Patent
Takahashi et al.

(10) Patent No.: US 10,704,808 B2
(45) Date of Patent: Jul. 7, 2020

(54) ULTRA-LOW TEMPERATURE FREEZER

(71) Applicant: PHC HOLDINGS CORPORATION, Tokyo (JP)

(72) Inventors: Yoshihiro Takahashi, Gunma (JP); Takashi Arai, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 116 days.

(21) Appl. No.: 15/892,146

(22) Filed: Feb. 8, 2018

(65) Prior Publication Data

US 2018/0163997 A1 Jun. 14, 2018

Related U.S. Application Data

(63) Continuation of application No. PCT/JP2016/072589, filed on Aug. 2, 2016.

(30) Foreign Application Priority Data

Aug. 26, 2015 (JP) ..... 2015-167043

(51) Int. Cl.
*F25D 3/00* (2006.01)
*F25D 19/04* (2006.01)
(Continued)

(52) U.S. Cl.
CPC ..... *F25B 7/00* (2013.01); *F25B 41/04* (2013.01); *F25D 11/00* (2013.01); *F25D 19/02* (2013.01);
(Continued)

(58) Field of Classification Search
CPC ..... F25D 3/102; F25D 3/105; F25D 3/107; F25D 19/04; F25D 23/006; F25D 11/025;
(Continued)

(56) References Cited

U.S. PATENT DOCUMENTS 2,855,263 A * 10/1958 Hutzelman ..... A47B 17/03 312/330.1
3,365,261 A * 1/1968 Gutner ..... A47B 88/483 312/334.34
(Continued)

FOREIGN PATENT DOCUMENTS

EP 2 019 270 A1 1/2009
JP 54-070170 U 5/1979
(Continued)

OTHER PUBLICATIONS

European Communication pursuant to Article 94(c) EPC, issued in European Patent Application No. 16 839 027.6, dated May 13, 2019.
(Continued)

*Primary Examiner* — Frantz F Jules
*Assistant Examiner* — Erik Mendoza-Wilkenfel
(74) *Attorney, Agent, or Firm* — McDermott Will & Emery LLP

(57) ABSTRACT

An ultra-low temperature freezer includes: an insulated case defining a storage compartment having an opening in an upper face; an insulated door capable of opening and closing the opening; a first refrigeration unit configured such that a first compressor, a first condenser, and a first decompressor are mounted on a first mounting board; a second refrigeration unit configured such that a second compressor, a second condenser, and a second decompressor are mounted on a second mounting board; a machinery compartment provided near the insulated case, and configured to house the first and second refrigeration units to be independently drawable in the horizontal direction; and a control unit, where a control circuit is mounted, configured to be drawable independently of the first and second refrigeration units, the first and second refrigeration units and the control unit being housed
(Continued)

in the machinery compartment to be stacked in a vertical direction.

19 Claims, 13 Drawing Sheets

(51) Int. Cl.
*F25B 7/00* (2006.01)
*F25D 19/02* (2006.01)
*F25B 41/04* (2006.01)
*F25D 11/00* (2006.01)

(52) U.S. Cl.
CPC ..... *F25D 19/04* (2013.01); *F25B 2400/06* (2013.01); *F25D 2400/30* (2013.01)

(58) Field of Classification Search
CPC ..... F25D 11/04; F25D 29/005; F25B 7/00; A47B 88/427; G07G 1/0027; G05B 2219/36156
USPC ..... 312/330.1, 334.1, 334.6, 334.7
See application file for complete search history.

(56) References Cited

U.S. PATENT DOCUMENTS 6,519,970 B1 * 2/2003 Rafalovich ..... F25D 23/003 62/428
2004/0221605 A1 * 11/2004 Chae ..... F25D 29/005 62/259.2
2009/0113917 A1 5/2009 Takasugi
2010/0147017 A1 * 6/2010 Takasugi ..... F25B 7/00 62/470
2011/0023532 A1 * 2/2011 Kobayashi ..... F25B 9/006 62/498

FOREIGN PATENT DOCUMENTS

JP 55-100979 U 7/1980
JP 61-030142 Y2 9/1986
JP 63-028393 Y 8/1988
JP 07-159025 A 6/1995
JP 10-288447 A 10/1998
JP 2004-020123 A 1/2004
JP 2005-172268 A 6/2005
JP 2011-241996 A 12/2011
JP 5026736 B2 9/2012

OTHER PUBLICATIONS

International Search Report and Written Opinion issued in International Patent Application No. PCT/JP2016/072589, dated Oct. 11, 2016; with partial English translation.
International Preliminary Report on Patentability issued in International Patent Application No. PCT/JP2016/072589, dated Jul. 19, 2017; with English translation.
Chinese Office Action and Search Report issued in corresponding Chinese Patent Application No. 201680046792.3, dated Aug. 26, 2019; with English translation.

* cited by examiner

ULTRA-LOW TEMPERATURE FREEZER

CROSS-REFERENCE TO RELATED APPLICATION

This is a continuation application of International Patent Application No. PCT/JP2016/072589 filed Aug. 2, 2016, which claims the benefit of priority to Japanese Patent Application No. 2015-167043 filed Aug. 26, 2015, the full contents of both of which are incorporated herein by reference.

BACKGROUND

Technical Field

The present disclosure relates to an ultra-low temperature freezer.

Description of the Related Art

Ultra-low temperature freezers have been developed, which are each configured to cool the interior of a storage compartment to an ultra-low temperature, for example, −80° C. or lower to preserve body tissues or store frozen food for a long period of time.

Such an ultra-low temperature freezer is configured such that, among the component devices of a refrigerant circuit, an evaporator is disposed to surround the storage compartment, while a compressor, a condenser, a decompressor, etc., are housed in a machinery compartment which is provided separately from the storage compartment (see, for example, Japanese Patent No. 5026736).

An ultra-low temperature freezer including a dual refrigerant circuit also has a similar configuration. In this case, devices housed in the machinery compartment increase as well as pipes connecting these devices one another also increases, which complicates the interior of the machinery compartment.

Thus, in order not to deteriorate the workability of assembly work, maintenance work, and the like for such devices housed in the machinery compartment, consideration is given to, for example, provision of enough space among the devices in the machinery compartment.

However, in another aspect, it is desired for the ultra-low temperature freezer to achieve a storage compartment having a larger capacity while minimizing the whole size. Accordingly, further rationalization is demanded of the machinery compartment.

The present disclosure has been made in view of the above, and an aspect thereof is to provide an ultra-low temperature freezer capable of rationalizing an arrangement of devices in a machinery compartment of the ultra-low temperature freezer having a dual refrigerant circuit, and enhancing maintainability and manufacturing workability.

SUMMARY

An ultra-low temperature freezer according to an aspect of the present disclosure comprises: an insulated case defining a storage compartment having an opening in an upper face; an insulated door configured to be able to open and close the opening; a first refrigeration unit configured such that a first compressor, a first condenser, and a first decompressor are mounted on a first mounting board; a second refrigeration unit configured such that a second compressor, a second condenser, and a second decompressor are mounted on a second mounting board; a machinery compartment provided adjacent to the insulated case, the machinery compartment configured to house the first refrigeration unit and the second refrigeration unit so as to be independently drawable in the horizontal direction; and a control unit where a control circuit is mounted, the control unit configured to be drawable independently of the first refrigeration unit and the second refrigeration unit, the first refrigeration unit, the second refrigeration unit, and the control unit being housed in the machinery compartment so as to be stacked in a vertical direction.

Other features of the present disclosure will become apparent from descriptions of the present specification and of the accompanying drawings.

BRIEF DESCRIPTION OF THE DRAWINGS

For more thorough understanding of the present disclosure and advantages thereof, the following description should be read in conjunction with the accompanying drawings.

DETAILED DESCRIPTION

At least the following matters will be made clear from the present description with reference to the accompanying drawings.

An ultra-low temperature freezer 1 according to an embodiment of the present disclosure is a refrigeration apparatus capable of cooling an interior of a storage compartment 4, which will be described later, to a predetermined temperature or lower (for example, −80° C. or lower) of an ultra-low temperature. The ultra-low temperature freezer 1 is suitable for the preservation at the ultra-low temperature of frozen food or body tissue and specimen to be preserved at a low temperature for a long period of time.

==Configuration of Ultra-Low Temperature Freezer==

Figure 1:
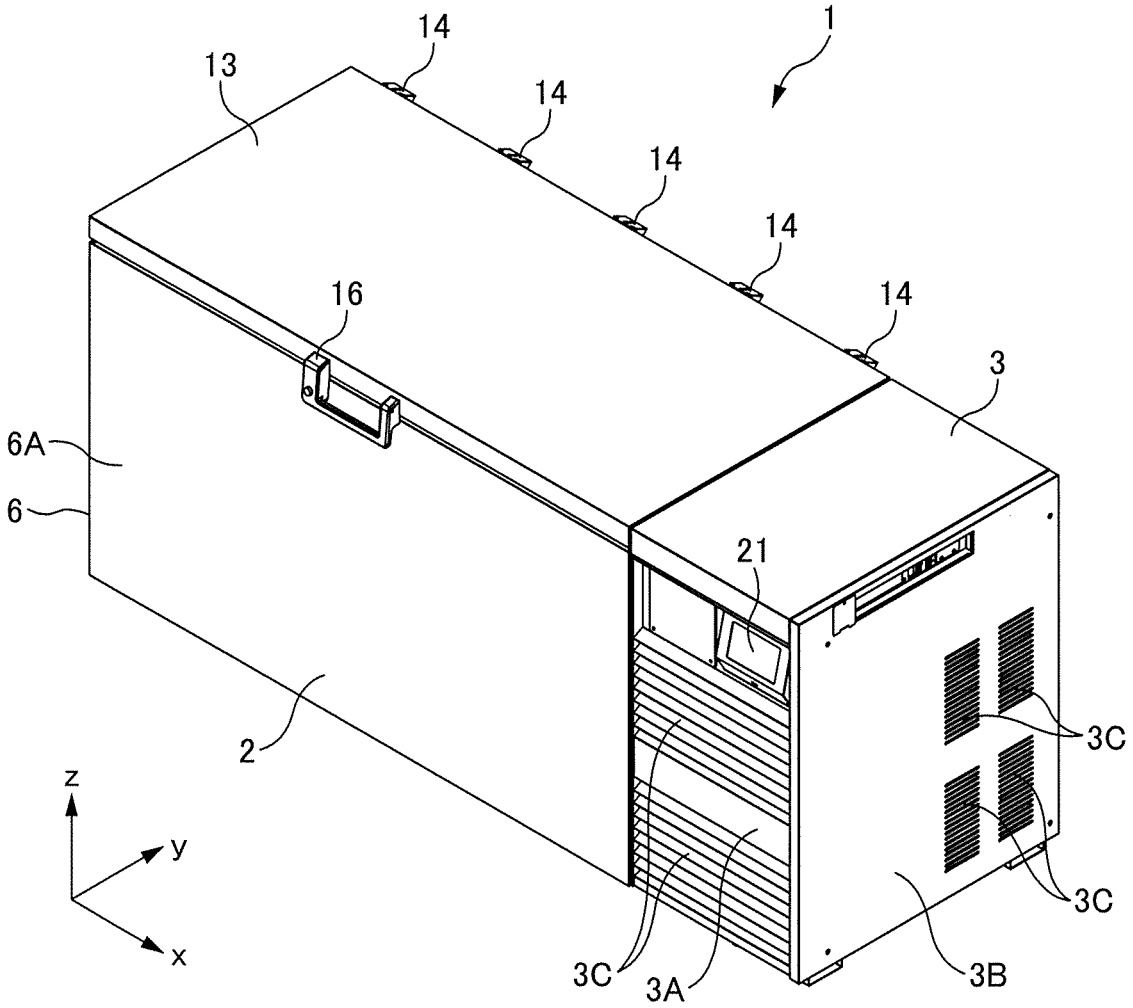
FIG. 1 is an external perspective view illustrating an ultra-low temperature freezer according to an embodiment of the present disclosure.
Figure 2:
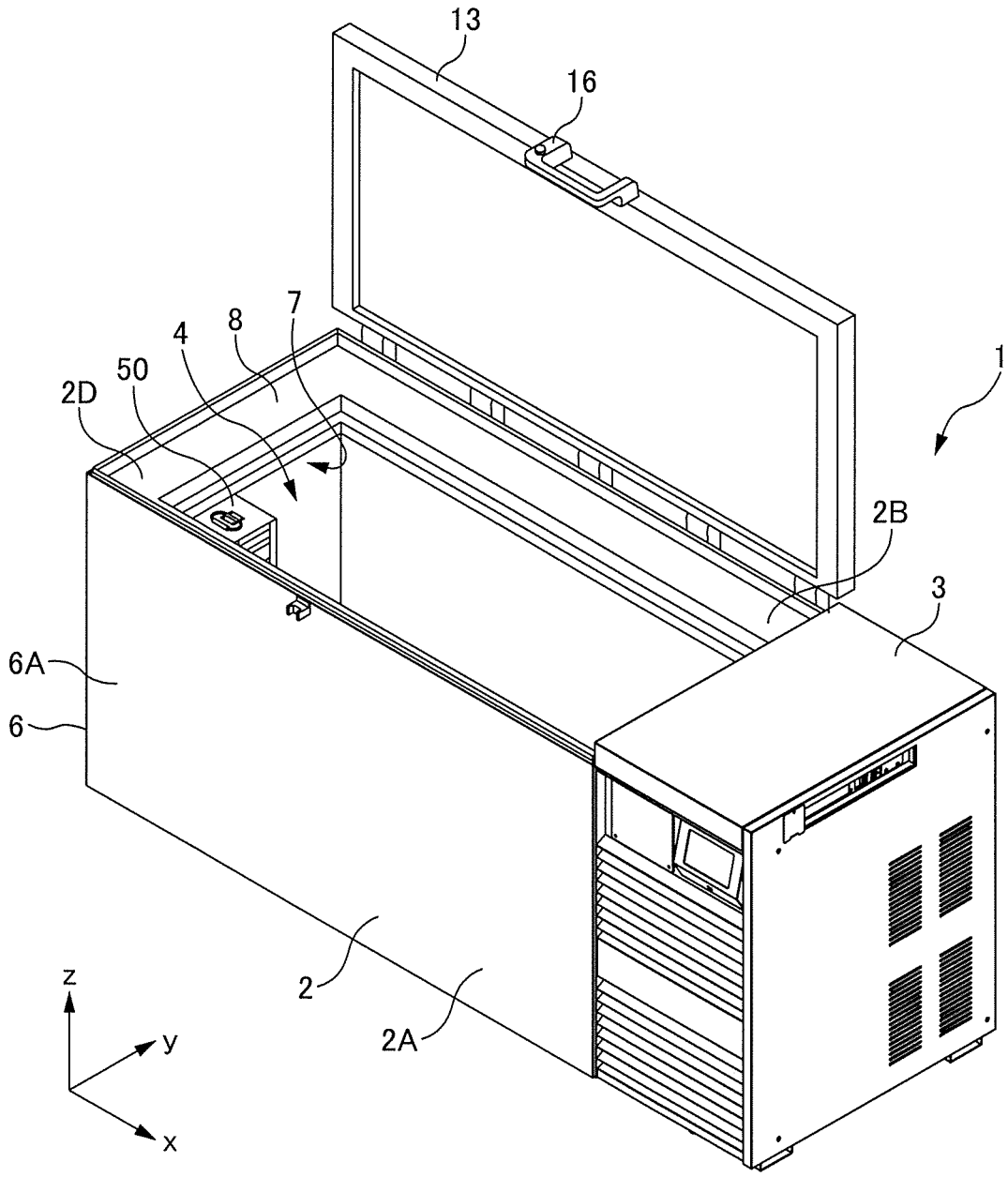
FIG. 2 is an external perspective view illustrating a state where an insulated door of an ultra-low temperature freezer according to an embodiment of the present disclosure is opened.
Figure 3:
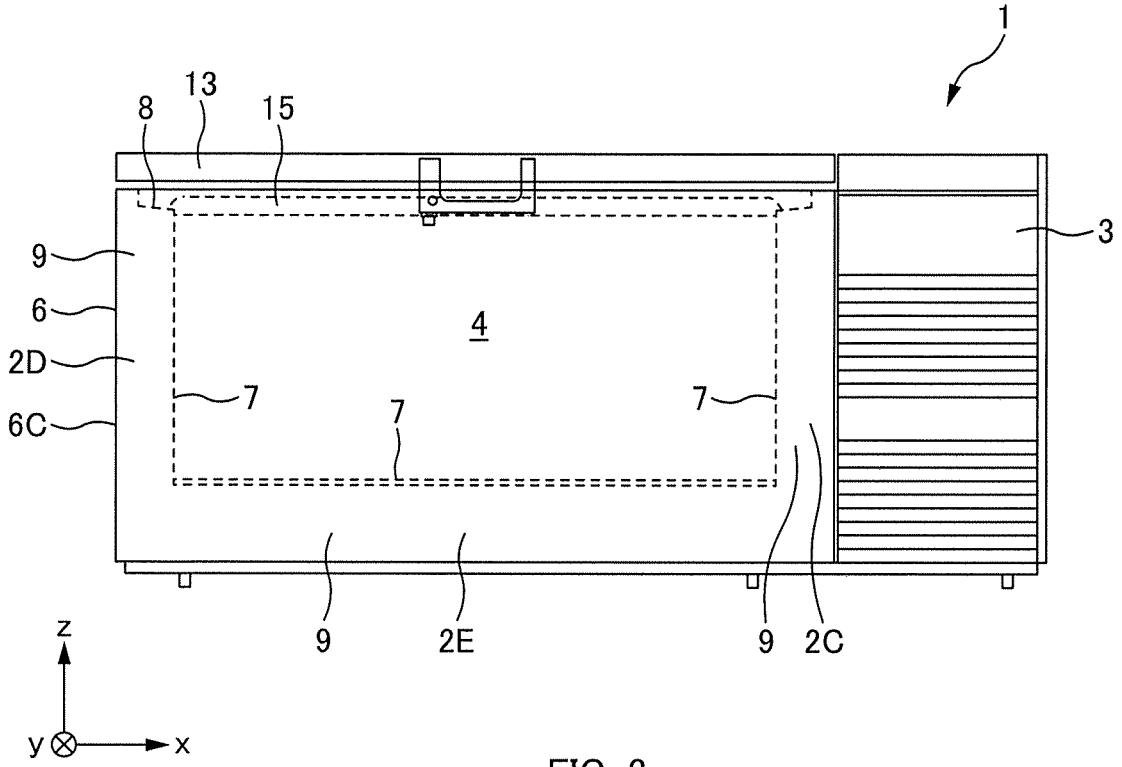
FIG. 3 is a perspective front view illustrating a storage compartment of an ultra-low temperature freezer according to an embodiment of the present disclosure.
Figure 4:
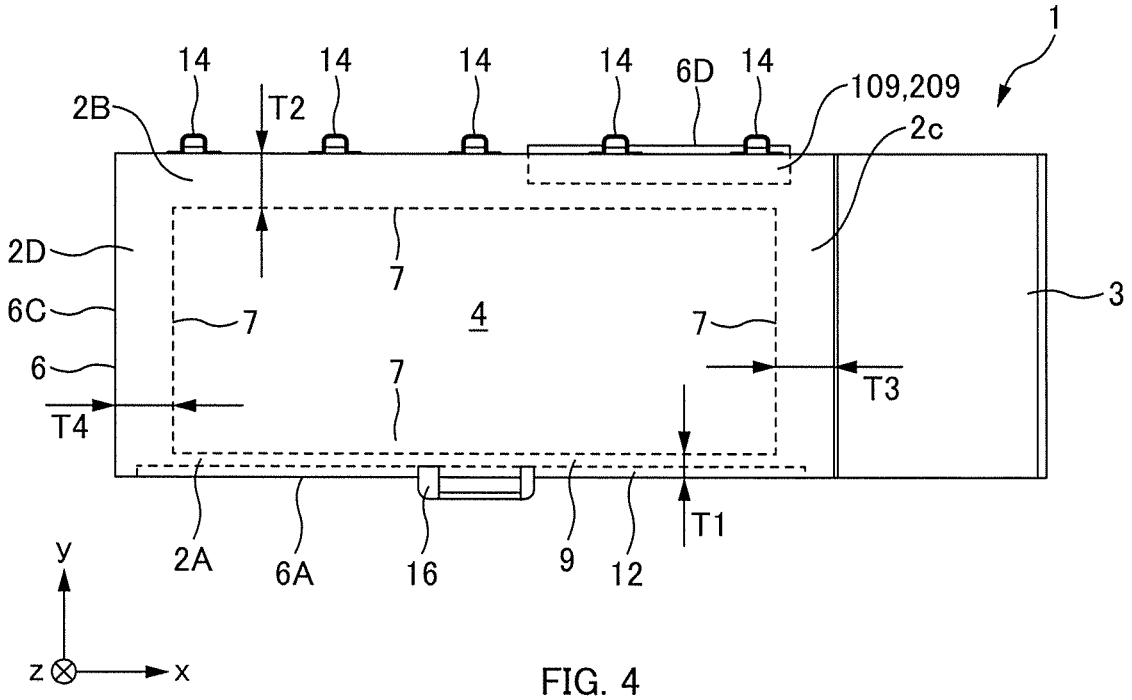
FIG. 4 is a perspective plan view illustrating a storage compartment of an ultra-low temperature freezer according to an embodiment of the present disclosure.
Figure 5:
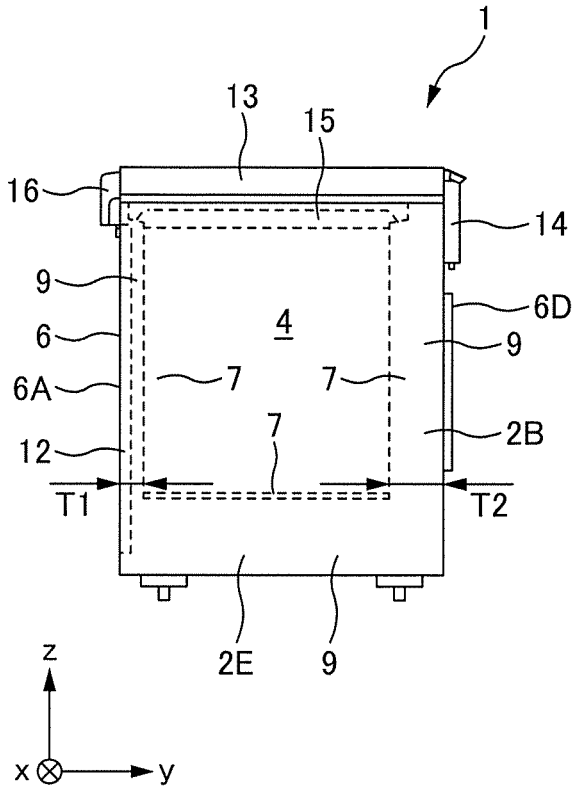
FIG. 5 is a perspective side view illustrating a storage compartment of an ultra-low temperature freezer according to an embodiment of the present disclosure.

FIG. 1 is an external perspective view illustrating the ultra-low temperature freezer 1 according to an embodiment of the present disclosure. FIG. 2 is an external perspective view illustrating a state where an insulated door 13 of the ultra-low temperature freezer 1 is opened. FIG. 3 is a perspective front view illustrating an interior of the storage compartment 4 of the ultra-low temperature freezer 1. FIG. 4 is a perspective plan view illustrating an interior of the storage compartment 4 of the ultra-low temperature freezer 1. FIG. 5 is a perspective side view illustrating an interior of the storage compartment 4 of the ultra-low temperature freezer 1.

Note that, in the following description, a direction from left to right when facing a front face of the ultra-low temperature freezer 1 is defined as a forward direction of an X-axis, a direction from the front to the rear is defined as a forward direction of a Y-axis, and a vertically upward direction is defined as a forward direction of a Z-axis.

The ultra-low temperature freezer 1 includes: a substantially rectangular parallelepiped insulated case 2 that defines the storage compartment 4 having an opening on an upper face; the insulated door 13 configured to be able to open and close the opening of the storage compartment 4; and a machinery compartment 3 disposed adjacent to and on a side of the insulated case 2.

The insulated case 2 includes a front insulated wall 2A, a rear insulated wall 2B, a right insulated wall 2C, a left insulated wall 2D and an insulated bottom 2E, and forms the storage compartment 4 in the interior thereof. In the interior of the storage compartment 4, a storage item, such as body tissue or food, is stored.

In the ultra-low temperature freezer 1 according to an embodiment of the present disclosure, as illustrated in FIG. 4, the front insulated wall 2A is formed such that a thickness T1 thereof becomes smaller than a thickness T2 of the rear insulated wall 2B, a thickness T3 of the right insulated wall 2C, and a thickness T4 of the left insulated wall 2D, to facilitate moving of a storage item into and out of the storage compartment 4.

The insulated case 2 is configured as such. Thus, when moving a storage item in and out of the storage compartment 4, a worker can lifts up and down a storage item at a position closer to the worker's standing place. This can facilitate moving in and out of a storage item. Accordingly, it becomes possible to move a storage item in and out of the storage compartment 4 in a short period of time, thereby being able to reduce a period of time in which the insulated door 13 should be kept open. This can minimize an increase in temperature within the storage compartment 4.

Further, a storage item can be lifted up and down at a position closer to a worker's standing place. Thus, it becomes possible to move a storage item in and out in a posture with less strain, thereby being able to enhance safety of the work.

The insulated door 13 is configured using a plurality of (5 pieces in an embodiment of the present disclosure) pivot members 14 that are disposed side by side along an upper end part of the rear insulated wall 2B, by pivoting on or being pivotally supported by these pivot members 14. The insulated door 13 is configured to open and close the opening of the insulated case 2 by pivoting on a central axis formed along the upper end part of the rear insulated wall 2B. A handle portion 16 is provided to the insulated door 13, and a worker operates the handle portion 16 to open and close the insulated door 13.

Further the insulated case 2 according to an embodiment of the present disclosure includes an inner case 7 whose upper face is configured to be opened, and an outer case 6 surrounding the inner case 7, a breaker 8, an insulating material 9, and a vacuum insulated panel 12.

The outer case 6 is configured with a board material made of a steel plate, and is open on the upper side and constitutes outer wall surfaces and outer bottom surface of the insulated case 2. The inner case 7 is configured with a board material made of metal having high thermal conductivity, such as aluminum, and similarly is open on the upper side and constitutes inner wall surfaces and inner bottom surface of the insulated case 2. The breaker 8 is a member made of a synthetic resin, and is mounted to connect between the outer case 6 and the inner case 7.

The insulating material 9 is a polyurethane resin filled in a space surrounded by the outer case 6, the inner case 7, and the breaker 8. The insulating material 9 is filled in each of the front insulated wall 2A, the rear insulated wall 2B, the right insulated wall 2C, the left insulated wall 2D and the insulated bottom 2E of the insulated case 2.

The vacuum insulated panel 12 is a member having insulating properties configured such that glass wool is stored in a casing constituted by a multi-layer film, such as aluminum and a synthetic resin, having no air permeability, the air in the casing is discharged by a predetermined vacuum discharge means, and an opening of the casing is joined by thermal welding, or the like.

The vacuum insulated panel 12 is mounted between the outer case 6 and the aforementioned insulating material 9 filled between the inner case 7 and the outer case 6.

The vacuum insulated panel 12 according to an embodiment of the present disclosure has insulating properties higher than that of the insulating material 9. Thus, the combined use of the insulating material 9 and the vacuum insulated panel 12 can achieve insulating properties higher than insulating properties in the case where only the insulating material 9 is used.

Accordingly, in the ultra-low temperature freezer 1 according to an embodiment of the present disclosure, the vacuum insulated panel 12 and the insulating material 9 are used in combination for the front insulated wall 2A. More specifically, in an embodiment of the present disclosure, the vacuum insulated panel 12 is mounted between the inner case 7 and the outer case 6 in the front insulated wall 2A. FIG. 4 illustrates a state where the ultra-low temperature freezer 1 according to an embodiment of the present disclosure has the vacuum insulated panel 12 in the front insulated wall 2A.

With such an embodiment, even in the case where the front insulated wall 2A is formed to have a thickness that is smaller than the thicknesses of the rear insulated wall 2B, the right insulated wall 2C, and the left insulated wall 2D, the front insulated wall 2A is able to ensure insulating properties equivalent to the insulating properties of the rear insulated wall 2B, the right insulated wall 2C and the left insulated wall 2D. Accordingly, it becomes possible to restrain power consumption that is necessary for cooling the interior of the storage compartment 4 to a predetermined temperature or lower (for example, −80° C. or lower).

Further, a configuration is made such that only the thickness of the front insulated wall 2A is reduced while the thicknesses of the rear insulated wall 2B, the right insulated wall 2C, and the left insulated wall 2D are made greater than the thickness of the front insulated wall 2A. This can minimize degradation of strength of the insulated case 2. Accordingly, reliability, such as failure tolerance and durability, of the ultra-low temperature freezer 1 can also be maintained.

Further, in the ultra-low temperature freezer 1 according to an embodiment of the present disclosure, as illustrated in FIG. 4, a configuration is made such that the vacuum insulated panel 12 is mounted between the insulating material 9 and the outer case 6 in the front insulated wall 2A.

Accordingly, the vacuum insulated panel 12 is mounted such that the insulating material 9 is interposed between the vacuum insulated panel 12 and the inner case 7. This can minimize reduction in the temperature of the vacuum insulated panel 12 caused by the inner case 7 which is cooled to such a degree equivalent to the degree of cooling the interior of the storage compartment 4, thereby being able to minimize degradation of insulation performance caused by damage, such as crack, fracture, and rupture, occurring in the vacuum insulated panel 12. Consequently, reliability, such as failure tolerance and durability of the ultra-low temperature freezer 1 can be maintained.

The interior of the storage compartment 4 is cooled by a first refrigerant circuit 100 and a second refrigerant circuit 200.

Although the details will be described later, the first refrigerant circuit 100 includes a first compressor 101, condensers 102, 104, a decompressor 108, and a first evaporator 111, and is configured to cool the interior (storage compartment 4) of the insulated case 2 to a predetermined temperature or lower by circulating a refrigerant in this order.

Similarly, the second refrigerant circuit 200 includes a second compressor 201, condensers 202, 204, a decompressor 208, and a second evaporator 211, and is configured to cool the interior (storage compartment 4) of the insulated case 2 to a predetermined temperature or lower by circulating a refrigerant in this order.

Then, the first evaporator 111 constituting the first refrigerant circuit 100 and the second evaporator 211 constituting the second refrigerant circuit 200 are mounted, to enable heat exchange, so as to surround the storage compartment 4 in a circumferential surface on the insulating material 9 side of the inner case 7 (outer circumferential surface of the inner case 7).

Further, a heat exchanger 109 constituting the first refrigerant circuit 100 and a heat exchanger 209 constituting the second refrigerant circuit 200 are provided, as illustrated in FIG. 4, within the rear insulated wall 2B of the insulated case 2, while being covered with the insulating material 9. Then, a portion of a rear wall 6B where the heat exchangers 109, 209 are provided is covered with a plate-shaped rear surface cover 6D.

Further, the first compressor 101, the condensers 102, 104, and the decompressor 108 constituting the first refrigerant circuit 100 are housed in the machinery compartment 3, as a first refrigeration unit 500A which will be described later, together with various devices such as a control circuit 300 of the ultra-low temperature freezer 1.

Similarly, the second compressor 201, the condensers 202, 204, and the decompressor 208 constituting the second refrigerant circuit 200 are housed in the machinery compartment 3, as a second refrigeration unit 500B which will be described later, together with various devices such as the control circuit 300 of the ultra-low temperature freezer 1.

The control circuit 300 includes a microcomputer 300*a* and memory, and is configured to execute a control program for controlling the ultra-low temperature freezer 1. The control circuit 300 is housed in the machinery compartment 3 as a control unit 400, which will be described later.

The machinery compartment 3 includes, as illustrated in FIG. 1, a front panel 3A, a rear panel 3D, and a side panel 3B constituting a side face opposite to the side on which the insulated case 2 is provided. Ventilation slits 3C are formed in the front panel 3A and the side panel 3B.

Further, in the front panel 3A of the machinery compartment 3, an operation panel 21 for operating the ultra-low temperature freezer 1 is provided.

Further, although not illustrated, a measurement hole passes through between the machinery compartment 3 and the insulated case 2. This measurement hole is formed to pass through the outer case 6 constituting the insulated case 2, the insulating material 9, and the inner case 7, so as to communicate between the storage compartment 4 and the machinery compartment 3. It is possible to insert a temperature sensor 309, 310 through the measurement hole from the machinery compartment 3 to the interior of the storage compartment 4.

A cable is drawn from the temperature sensor 309, 310, which is inserted into the storage compartment 4, to the machinery compartment 3 through the measurement hole. The cable is coupled to the control circuit 300 in the machinery compartment 3. Then, in this measurement hole, a gap formed with the cable is closed with a plug made of a spongelike deformable material having insulating properties. Note that, in a state where the temperature sensor 309, 310 is not mounted, the measurement hole is closed in an insulating manner with this plug.

==Refrigerant Circuit of Ultra-Low Temperature Freezer==

Figure 6:
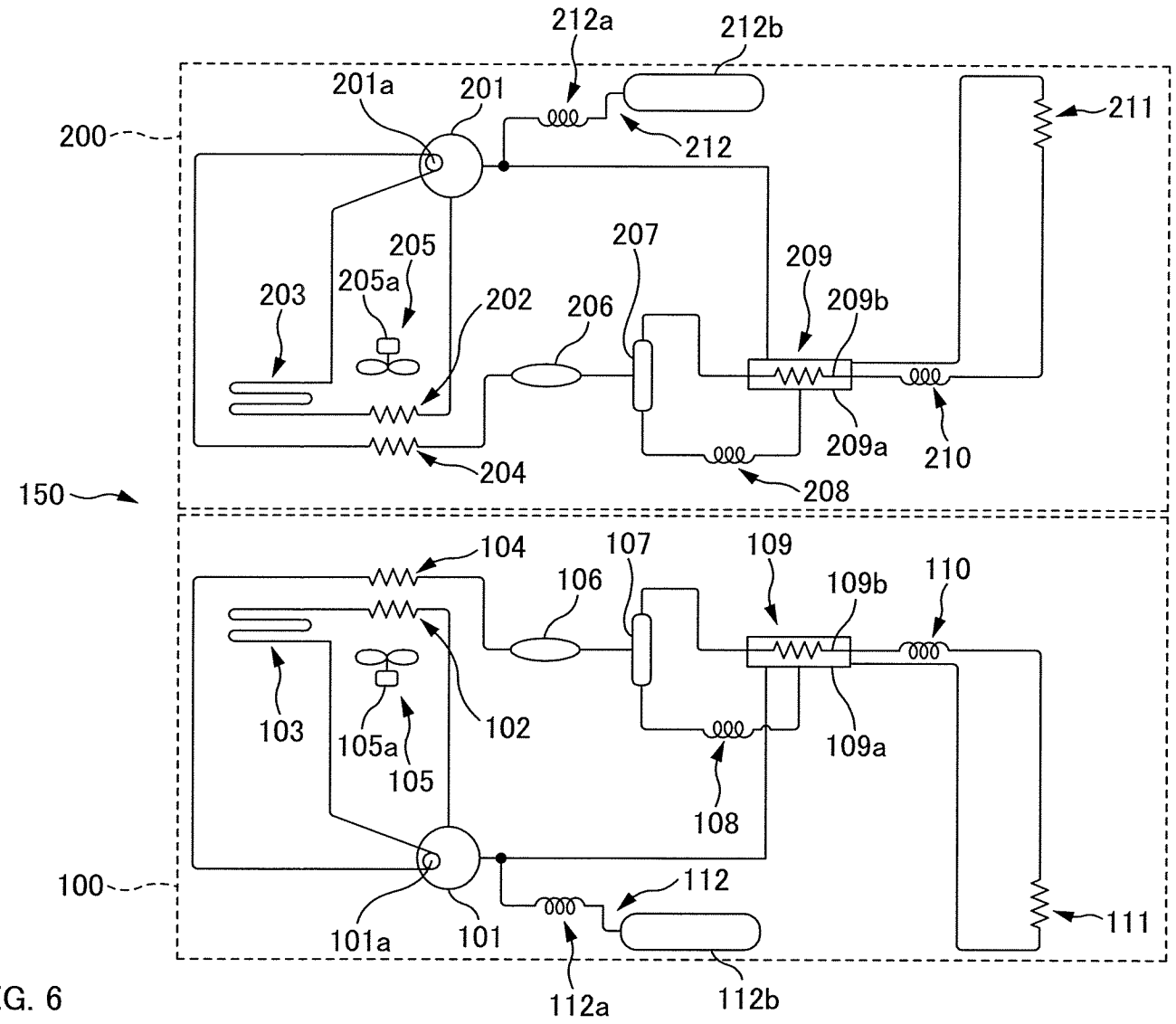
FIG. 6 is a diagram illustrating a refrigerant circuit of an ultra-low temperature freezer according to an embodiment of the present disclosure.

Next, a refrigerant circuit 150 of the ultra-low temperature freezer 1 according to an embodiment of the present disclosure will be described with reference to FIG. 6. FIG. 6 is a circuit diagram illustrating an example of the refrigerant circuit 150 according to an embodiment of the present disclosure.

As indicated in an example in FIG. 6, the refrigerant circuit 150 includes two substantially identical refrigerant circuits, that is, the first refrigerant circuit 100 and the second refrigerant circuit 200.

<<<First Refrigerant Circuit>>>

The first refrigerant circuit 100 includes the first compressor 101, the upstream condenser 102 and the downstream condenser 104, a shunt 107 configured to separate gas and liquid, the decompressor 108 and the heat exchanger 109, and a decompressor 110 and the first evaporator 111. The first refrigerant circuit 100 is configured in an annular manner so that that a refrigerant discharged from the first compressor 101 is returned to the first compressor 101 again. In the first refrigerant circuit 100, for example, a zeotropic refrigerant mixture (hereinafter, simply referred to as the "refrigerant") containing four types of refrigerants, which will be described later, is sealed.

Further, in this first refrigerant circuit 100, an oil cooler 101*a* is provided at an oil reservoir within the first compressor 101, a pipe 103 is provided between the upstream condenser 102 and the oil cooler 101*a*, a dehydrator 106 is provided between the downstream condenser 104 and the shunt 107, a buffer 112 is provided between the first compressor 101 on the intake side and the heat exchanger 109.

Further, the first refrigerant circuit 100 includes a first fan 105 to cool the upstream condenser 102 and the downstream condenser 104. The first fan 105 is a propeller blower including a fan motor 105*a*.

The first compressor 101 is configured to compress and discharge the intake refrigerant to the upstream condenser 102.

The upstream condenser 102 is configured such that, for example, a copper or aluminum tube to radiate the heat of the refrigerant discharged from the first compressor 101 is formed into a meander shape.

The downstream condenser 104 is configured such that, for example, a copper or aluminum tube to further radiate the heat of the refrigerant outputted from the upstream condenser 102 is formed into a meander shape.

These upstream condenser 102 and downstream condenser 104 are integrally configured in a single tube sheet.

The shunt 107 is configured to separate the refrigerant outputted from the downstream condenser 104 into the refrigerant in a liquid phase and the refrigerant in a gas phase, and decompress the refrigerant in the liquid phase through the decompressor (capillary tube) 108, and thereafter evaporate the decompressed refrigerant in an outer tube 109*a* of the heat exchanger 109.

The heat exchanger 109 is, for example, a metal or aluminum double tube including the outer tube 109*a* and an inner tube 109*b*. The refrigerant in the gas phase from the shunt 107 flows through the inner tube 109*b*, and the refrigerant in the gas phase, which is obtained by evaporating the refrigerant in the liquid phase, flowing through the inner tube 109*b* is cooled at the outer tube 109*a*.

The decompressor 110 is, for example, a capillary tube, configured to decompress the refrigerant having entered the liquid phase by being cooled at the inner tube 109*b* of the heat exchanger 109, and output the decompressed refrigerant to the first evaporator 111.

The first evaporator 111 is, for example, a copper or aluminum tube to evaporate the refrigerant decompressed by the decompressor 110. As described above, the first evaporator 111 is, for example, attached to the outer faces except the upper opening of the inner case 7 so as to thermally contact the outer faces. Note that such attachment of the first evaporator 111 is not limited to this, as long as a configuration allowing thermal contact.

The refrigerant is configured to cool an interior of the inner case 7 by cooling action when being evaporated (vaporized) in the first evaporator 111. This refrigerant having entered the gas phase by evaporation is taken into the compressor 101 in the heat exchanger 109 together with the previously evaporated refrigerant.

Note that the pipe 103 is provided inside the peripheral portion of the upper face opening of the outer case 6. This peripheral portion of the upper face opening is a portion where packing (not illustrated) mounted to the insulated door 13 closely contact in a state where the aforementioned insulated door 13 is closed, and the high-temperature refrigerant discharged from the compressor 101 flows in the pipe 103. Thus, heating by this refrigerant prevents condensation which is caused by cooling from the low-temperature inner case 7 side. This can enhance hermeticity within the outer case 6. Further, the dehydrator 106 is configured to remove moisture contained in the refrigerant. Further, the buffer 112 includes a capillary tube 112*a* and an expansion tank 112*b*, and the amount of the refrigerant that circulates in the first refrigerant circuit 100 is maintained appropriate by taking the refrigerant in the gas phase on the intake side of the first compressor 101 into the expansion tank 112*b* through the capillary tube 112*a*.

<<<Second Refrigerant Circuit>>>

The second refrigerant circuit 200 includes, similarly to the above, the second compressor 201, the upstream condenser 202 and the downstream condenser 204, a shunt 207 configured to separate gas and liquid, the decompressor 208 and the heat exchanger 209, and a decompressor 210 and the second evaporator 211. The second refrigerant circuit 200 is configured in an annular manner so that a refrigerant discharged from the second compressor 201 is returned to the second compressor 201 again. In the second refrigerant circuit 200, the refrigerant similar to the above is sealed. Further, this second refrigerant circuit 200 includes, similarly to the above, an oil cooler 201*a*, a pipe 203, a dehydrator 206, and a buffer 212. Here, the heat exchanger 209 includes an outer tube 209*a* and an inner tube 209*b*. Further, the buffer 212 includes a capillary tube 212*a* and an expansion tank 212*b*.

In the second refrigerant circuit 200, a second fan 205 is provided to cool the upstream condenser 202 and the downstream condenser 204. The second fan 205 is a propeller blower including a fan motor 205*a*.

Note that the aforementioned pipe 103 and pipe 203 are provided inside the peripheral portion of the upper face opening of the outer case 6, for example, so as to overlap each other. The aforementioned first evaporator 111 and second evaporator 211 are, for example, attached in such a manner as to thermally contact the outer faces except the upper face opening of the inner case 7, for example, so as not to overlap each other.

<<<Refrigerant>>>

The refrigerant according to an embodiment of the present disclosure is, for example, a zeotropic refrigerant mixture containing R245fa, R600, R23, and R14. Here, R245fa indicates Pentafluoropropane ($CHF_2CH_2CF_3$), and has a boiling point of +15.3° C. R600 indicates normal butane (n-$C_4H_{10}$), and has a boiling point of −0.5° C. R23 indicates Trifluoromethane ($CHF_3$), and has a boiling point of −82.1° C. R14 indicates Tetrafluoromethane ($CF_4$), and has a boiling point of −127.9° C.

Note that R600 has a high boiling point (evaporation temperature), and easily contains oil, water, etc. Further, R245fa is a refrigerant to be made noncombustible by being mixed with R600, which is combustible, at a predetermined ratio (e.g., R245fa and R600 are in the ratio of 7:3).

In the first refrigerant circuit 100, the refrigerant compressed in the first compressor 101 radiates heat in the upstream condenser 102 and the downstream condenser 104, and is condensed to enter the liquid phase. Then, the refrigerant in the liquid state is subjected to a moisture removal process in the dehydrator 106, and thereafter is separated, in the shunt 107, into the refrigerant in the liquid phase (mainly R245fa, R600 having a high boiling temperature) and the refrigerant in the gas state (R23, R14). Note that, in an embodiment of the present disclosure, the refrigerant having radiated heat in the upstream condenser 102 cools the oil within the first compressor 101 at the oil cooler 101*a*, and thereafter radiates heat again in the downstream condenser 104.

The refrigerant in the separated liquid state (mainly R245fa, R600) is decompressed in the decompressor 108, and thereafter is evaporated at the outer tube 109*a* in the heat exchanger 109.

The refrigerant in the separated gas state (R23, R14) is cooled and condensed by the heat of evaporation of the aforementioned refrigerant (R245fa, R600) evaporated in the outer tube 109*a* and the refrigerant in the gas phase (R23, R14) returned from the first evaporator 111, while passing through the inner tube 109*b* of the heat exchanger 109, resulting in the refrigerant in the liquid state. At this time, the refrigerant having not been evaporated in the first evaporator 111 is evaporated.

Note that the second refrigerant circuit 200 is similar to the above.

Further, as described above, R245fa has a boiling point of about 15° C., R600 has a boiling point of about 0° C., R23 has a boiling point of about −82° C., and R14 has a boiling point of about −128° C. Accordingly, in the first refrigerant circuit 100 and the second refrigerant circuit 200, R23 and R14 in the zeotropic refrigerant mixture are cooled through vaporization action of R600, and R23, R14 having entered in the liquid phase are guided to the first evaporator 111 and the second evaporator 211, and evaporated. This can cause an item to be cooled, for example, to a temperature corresponding to a boiling point of R23 and R14 (e.g., about −82° C. to −128° C.). Note that the refrigerant having not been evaporated in the first evaporator 111 and the second evaporator 211 is evaporated in the heat exchangers 109, 209.

<<<Control Circuit>>>

Next, the control circuit 300 according to an embodiment of the present disclosure will be described with reference to FIG. 14.

The control circuit 300 according to an embodiment of the present disclosure includes a control board 301, a switching power supply 302, a power supply switch 304, compressor relays 305, and relays 306, to control the first compressor 101 and the fan motor 105*a* of the first refrigerant circuit 100, and the second compressor 201 and the fan motor 205*a* of the second refrigerant circuit 200.

Note that, as will be described later, the above described components of the control circuit 300 are mounted onto a control-unit-mounting board 410, and housed in the machinery compartment 3 as the control unit 400.

Then, the control circuit 300 is configured to be connected to a first compressor temperature sensor 307 configured to detect a temperature of the first compressor 101, a second compressor temperature sensor 308 configured to detect a temperature of the second compressor 201, a first temperature sensor 309 configured to detect a temperature within the freezer so as to control the first compressor 101, a second temperature sensor 310 configured to detect a temperature within the freezer so as to control the second compressor 201, a first sensor 311 configured to detect a temperature of the first fan 105, and a second sensor 312 configured to detect a temperature of the second fan 205.

The control board 301 includes a microcomputer 301*a*, and is configured to output control signals for opening and closing two relays 306 in response to detection signals from the first compressor temperature sensor 307 and the second compressor temperature sensor 308, and also output control signals for starting or stopping the operations of the fan motor 105*a*, 205*a*.

The microcomputer 301*a* is configured to, when detecting that a temperature of the first compressor 101 detected by the first compressor temperature sensor 307 has exceeded a predetermined temperature during the operation of the first compressor 101, operate the compressor relay 305 corresponding to the first compressor 101 through the relay 306 corresponding to the first compressor 101, thereby interrupting an input of a three-phase voltage to the first compressor 101. This functions as a protection circuit with respect to increase in temperature of the first compressor 101. The same applies to the second compressor 201.

The first compressor 101 and the second compressor 201 are configured to, when the power supply switch 304 is turned on, be supplied with electric power from three-phase power supply cables 303, and start an operation of compressing a refrigerant. Further, although not illustrated, the microcomputer 301*a* is configured to, for example, compare a temperature within the freezer detected using the first temperature sensor 309 and a predetermined temperature, and control the rotation speed of a motor (not illustrated) of the first compressor 101 in accordance with the result of such comparison. This controls compression performance of the first compressor 101 according to the temperature within the freezer, and the same applies to the second compressor 201. Note that the first temperature sensor 309 and the second temperature sensor 310 may be the same single sensor.

Figure 14:
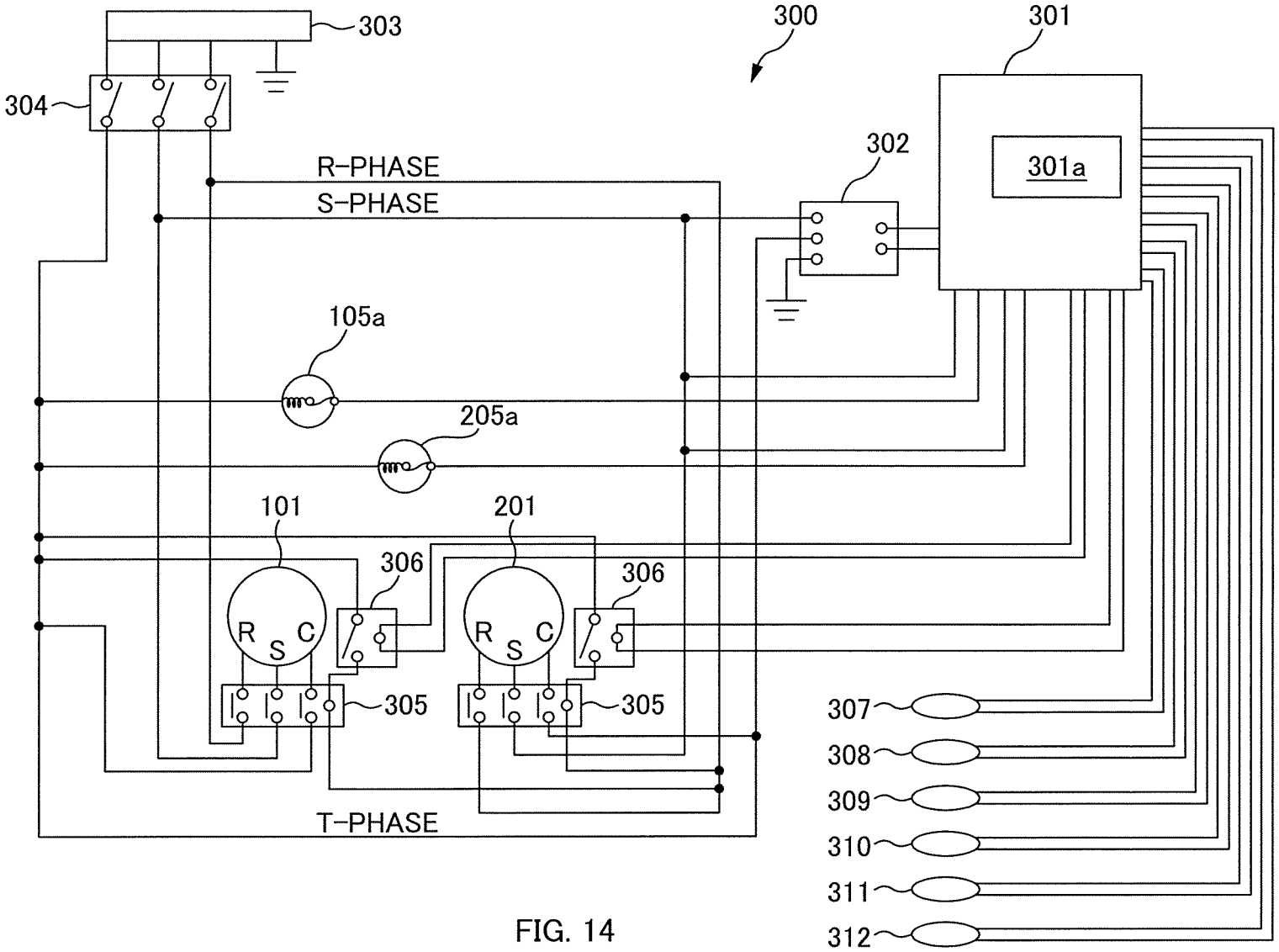
FIG. 14 is a diagram illustrating a control circuit according to an embodiment of the present disclosure.

In addition, as illustrated in an example of FIG. 14, the microcomputer 301*a* is configured to control the fan motors 105*a*, 205*a* other than the above-described control of the first compressor 101 and the second compressor 201. Further, although not illustrated, the microcomputer 301*a* is configured to, for example, when detecting that a temperature of the first fan 105 detected with the first sensor 311 has exceeded a predetermined temperature, stop the operation of the fan motor 105*a*. This functions as a protection circuit with respect to increase in temperature of the first fan 105, and the same applies to the second fan 205. Note that the first sensor 311 and the second sensor 312 may be, for example, a shared single sensor provided adjacent to both the fan motors 105*a*, 205*a*.

===Machinery Compartment (Machinery Case)===

Next, the machinery compartment 3 of the ultra-low temperature freezer 1 according to an embodiment of the present disclosure will be described with reference to FIGS. 7 to 13.

Figure 7:
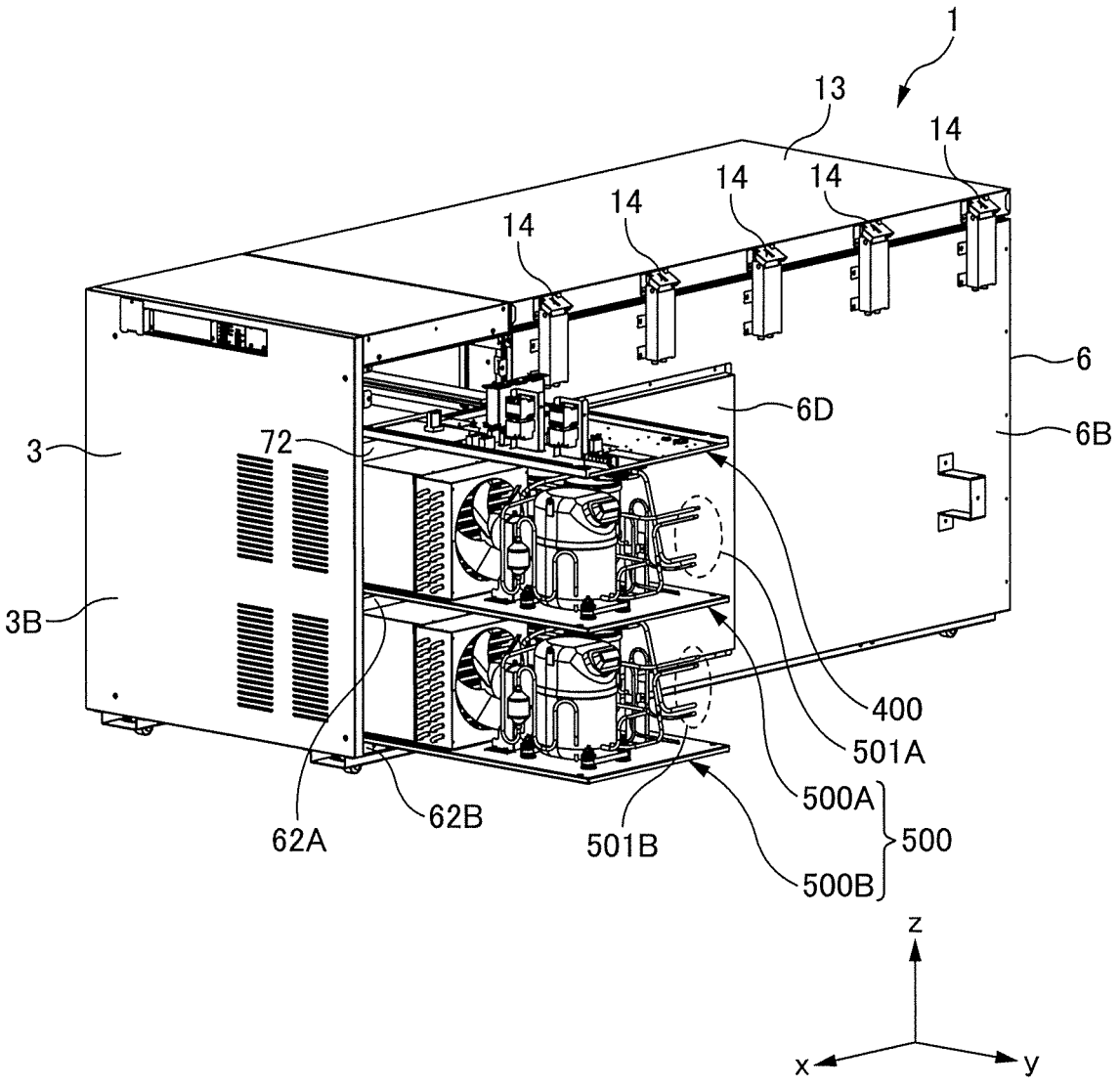
FIG. 7 is a perspective diagram when viewed from a back side of an ultra-low temperature freezer according to an embodiment of the present disclosure.

As illustrated in FIG. 7, in the machinery compartment 3, the control unit 400 and a refrigeration unit 500 (first refrigeration unit 500A and second refrigeration unit 500B) are housed so as to be independently drawable in a horizontal direction (Y-axis direction in an embodiment of the present disclosure).

Figure 11:
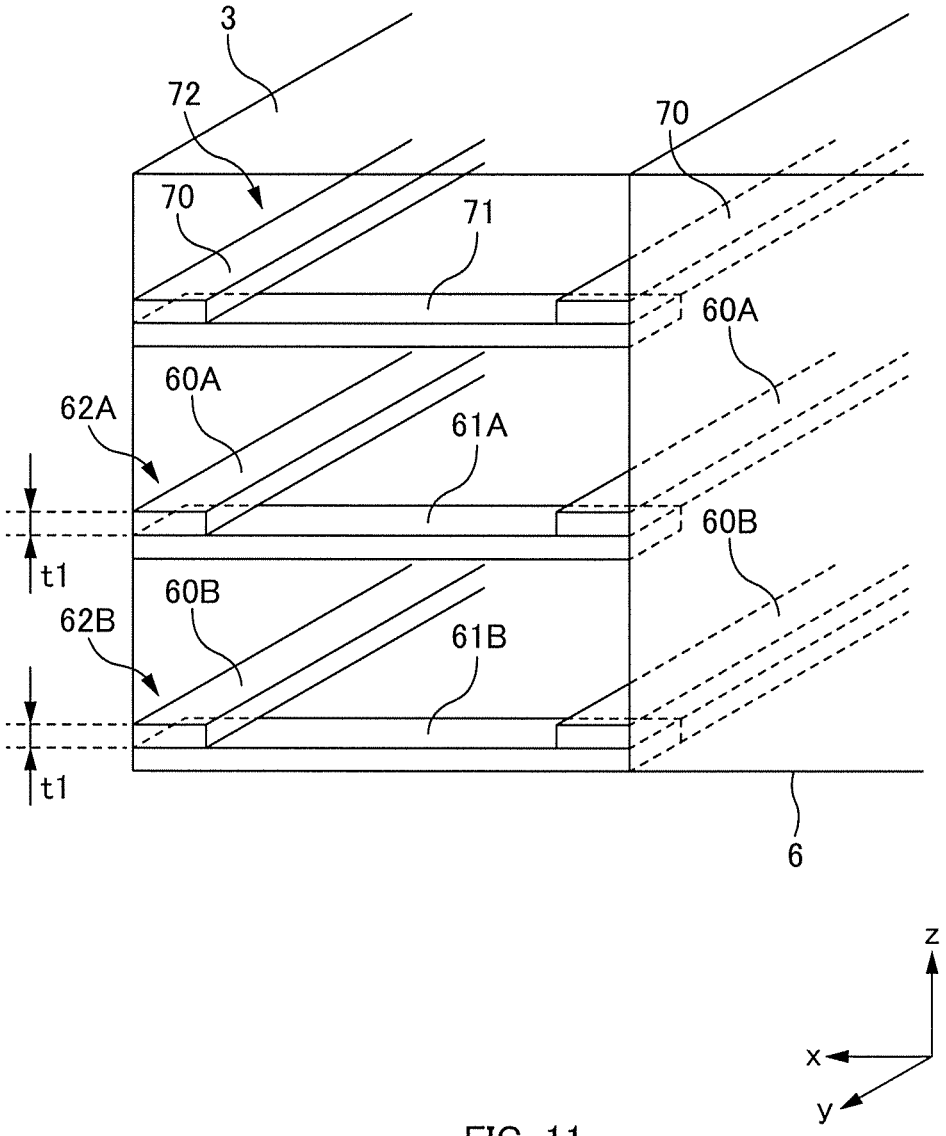
FIG. 11 is a diagram illustrating a storage rack provided to a machinery compartment according to an embodiment of the present disclosure.

Then, as illustrated in FIG. 11, the machinery compartment 3 includes a control-unit-storage rack 72 for housing the control unit 400 so as to be drawable in the horizontal direction, and a refrigeration-unit-storage rack 62 (first refrigeration-unit-storage rack 62A, second refrigeration-unit-storage rack 62B) for housing the refrigeration unit 500 so as to be drawable in the horizontal direction.

<<<Control Unit>>>

Figure 13:
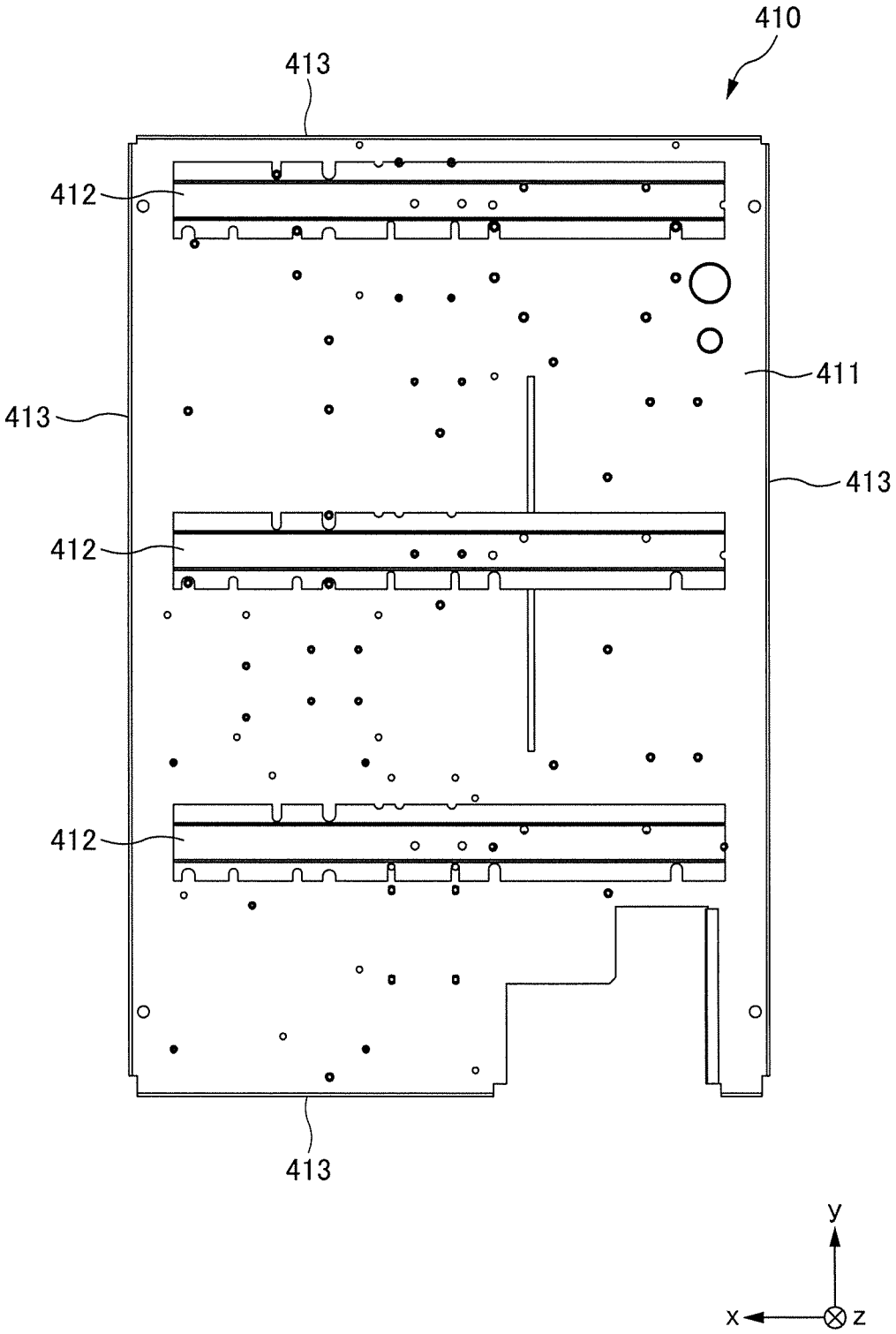
FIG. 13 is an external perspective view illustrating a mounting board for a control unit according to an embodiment of the present disclosure.

The control unit 400 is configured such that various components such as the control board 301 and the switching power supply 302, etc., constituting the control circuit 300 are mounted on the control-unit-mounting board 410 made of a substantially rectangular metal plate illustrated in FIG. 13.

FIG. 13 is a diagram illustrating the control-unit-mounting board 410 when viewed from a lower surface side opposite to an upper surface where the control circuit 300 is mounted. As illustrated in FIG. 13, the control-unit-mounting board 410 includes a substantially rectangular main body portion 411 where the control circuit 300 is to be mounted, and reinforcing plates 412.

The reinforcing plates 412 are mounted to the main body portion 411 on the lower surface side, along a direction (X-axis direction, lateral direction of the main body portion 411) intersecting the direction (Y-axis direction, longitudinal direction of the main body portion 411) in which the control unit 400 is drawn out. The reinforcing plates 412 are mounted, for example, to the main body portion 411 by welding.

In the control-unit-mounting board 410, a mounting hole for mounting a component of the control circuit 300 cannot be created at a location where the reinforcing plates 412 are mounted. However, mounting of the reinforcing plates 412 along the lateral direction of the main body portion 411 can reduce the area covered by the reinforcing plates 412 in the surface area of the main body portion 411 as compared with the case where the reinforcing plates 412 are mounted along the longitudinal direction. This can reduce interference with the reinforcing plate 412 when creating a mounting hole in the main body portion 411.

The provision of the reinforcing plates 412 to the control-unit-mounting board 410 can minimize deformation of the control-unit-mounting board 410 caused by the weight of the control unit 400.

Further, as illustrated in FIG. 13, the main body portion 411 includes folded portions 413 formed by folding edge portions toward a direction (for example, +Z direction) intersecting a surface (X-Y plane) where the control circuit 300 is mounted.

Such an embodiment can further minimize deformation of the control-unit-mounting board 410 caused by the weight of the control unit 400.

<<<Control-Unit-Storage Rack>>>

As illustrated in FIG. 11, the control-unit-storage rack 72 includes a pair of rail members 70 extending in the direction (Y-axis direction) in which the control unit 400 is drawn out, and a transverse member 71 extending in the direction (X-axis direction) of traversing such a drawing put direction.

The pair of rail members 70 extends in the direction in which the control unit 400 is drawn out in such a manner as to contact the pair of folded portions 413 of the control-unit-mounting board 410. Then, the control unit 400 is housed into the control-unit-storage rack 72, with the control-unit-mounting board 410 being supported by the pair of rail members 70.

With such an embodiment, it becomes possible to house/draw the control unit 400 into/out of the machinery compartment 3 with a smaller force.

Further, as in an embodiment of the present disclosure, the control circuit 300 is mounted on the control-unit-mounting board 410 to be integrally configured as the control unit 400. This can enhance maintainability and manufacturing workability of the ultra-low temperature freezer 1.

For example, if a component part of the control circuit 300 is broken, the whole control unit 400 where the broken part is mounted can be easily demounted from the machinery compartment 3. Then, the control unit 400 is replaced with a new one, which enables the repair of such failure in a short period of time.

Alternatively, the broken part can be repaired or replaced in a state where the whole control unit 400 where the broken part is mounted is demounted from the machinery compartment 3. Accordingly, such work is not required to be conducted within the small machinery compartment 3.

<<<Refrigeration Unit>>>

Next, the refrigeration unit 500 will be described. The ultra-low temperature freezer 1 according to an embodiment of the present disclosure includes, as described above, the first refrigeration unit 500A and the second refrigeration unit 500B.

Figure 8:
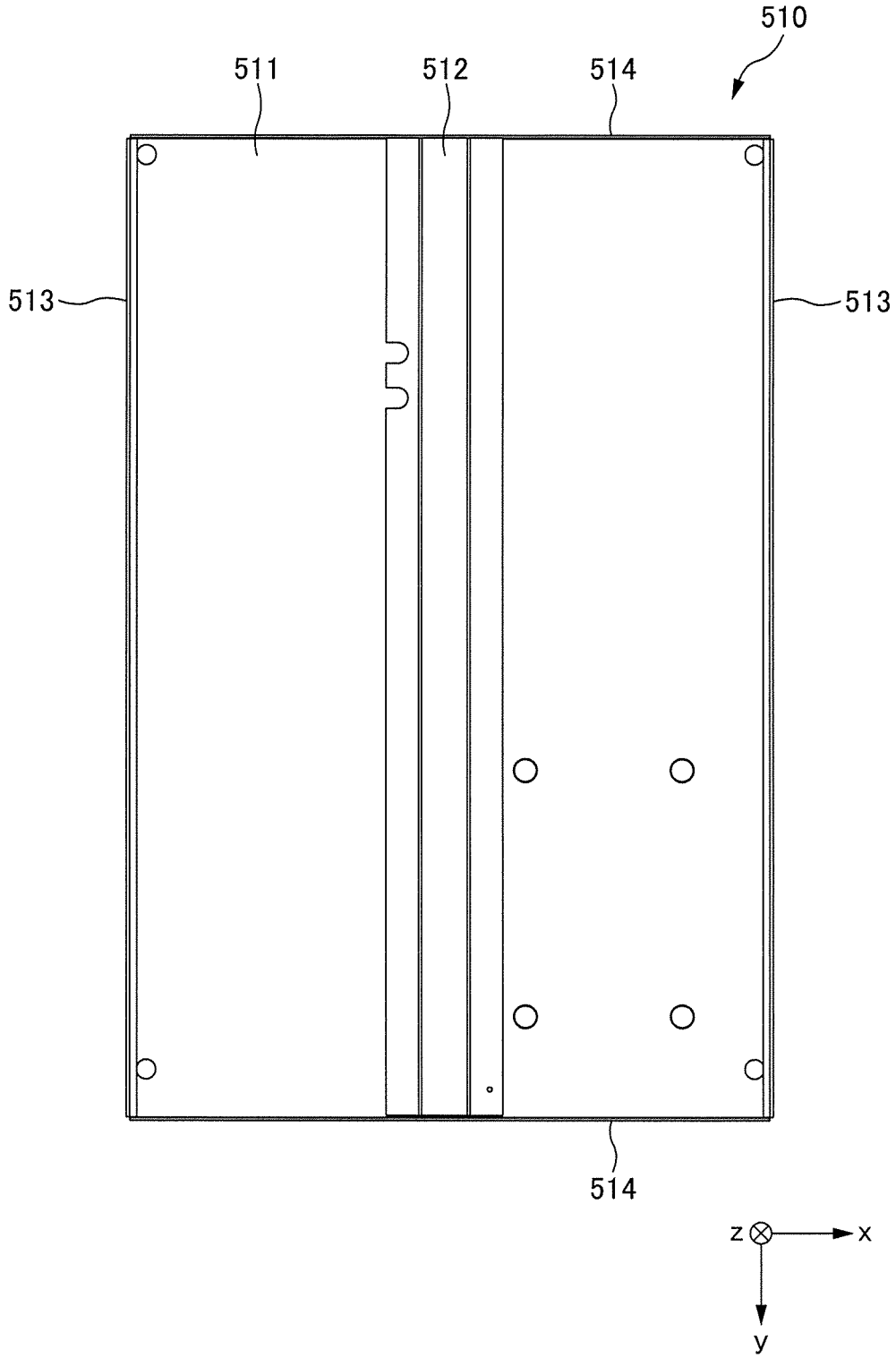
FIG. 8 is a plan view illustrating a mounting board for a refrigeration unit according to an embodiment of the present disclosure.

The first refrigeration unit 500A is configured such that components, such as the compressor 101, the condensers 102, 104, and the decompressor 108 which constitute the refrigerant circuit 100, are mounted on a mounting board 510 that is configured with a substantially rectangular metal plate illustrated in FIG. 8.

Further, the second refrigeration unit 500B is also configured such that components, such as the compressor 201, the condensers 202, 204, the decompressor 208, which constitute the refrigerant circuit 200, are mounted on a mounting board 510 that is configured with a substantially rectangular metal plate illustrated in FIG. 8.

The first refrigeration unit 500A and the second refrigeration unit 500B according to an embodiment of the present disclosure have the same shape as each other, and are configured to be interchangeable with each other. For example, the arrangement of the components, such as, the compressor 101, the condensers 102, 104, and the decompressor 108 in the first refrigeration unit 500A is the same as the arrangement of the components, such as the compressor 201, the condensers 202, 204, and the decompressor 208, in the second refrigeration unit 500B.

Thus, in the following, although a description will be made focusing on the first refrigeration unit 500A to avoid repetition, the same applies to the second refrigeration unit 500B.

FIG. 8 is a diagram illustrating the mounting board 510 when viewed from a lower surface side opposite to an upper surface where the components, such as the compressor 101, the condensers 102, 104, and the decompressor 108, are mounted. As illustrated in FIG. 8, the mounting board 510 includes: a substantially rectangular main body portion 511 where the components, such as the compressor 101, the condensers 102, 104, and the decompressor 108, are mounted; and a reinforcing portion (first reinforcing portion, second reinforcing portion) 512.

Figure 10:
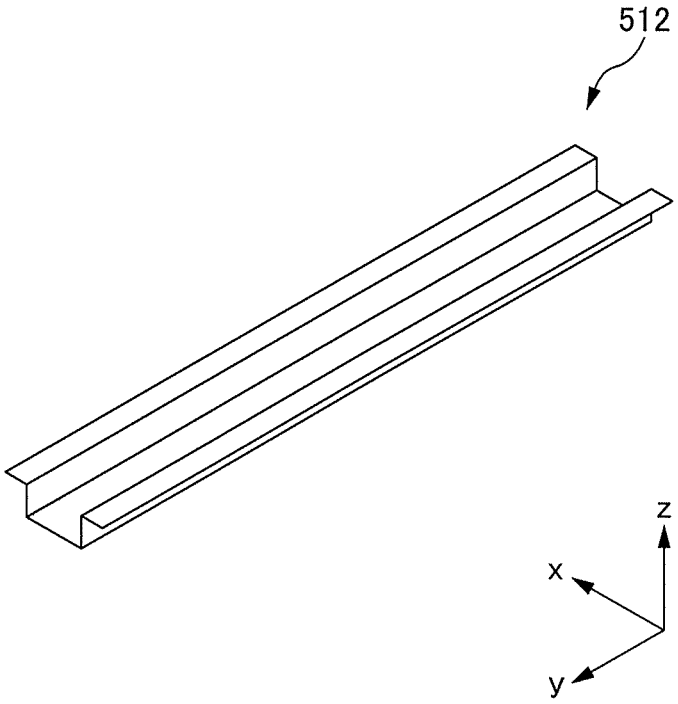
FIG. 10 is a diagram illustrating a reinforcing portion of a mounting board according to an embodiment of the present disclosure.

The reinforcing portion 512 is formed on the lower surface side of the main body portion 511 so as to extend along the direction (Y-axis direction, longitudinal direction of the main body portion 511) in which the first refrigeration unit 500A is drawn out. The reinforcing portion 512 is configured, as illustrated in FIG. 10, such that the metal plate member 512 formed by being bent along a straight line is mounted (for example, welded) to the lower surface of the mounting board 510, in the direction in which the first refrigeration unit 500A is drawn out. Such a configuration that the mounting board 510 is provided with the reinforcing portion 512 can minimize the deformation of the mounting board 510 caused by the weight of the first refrigeration unit 500A.

Further, the reinforcing portion 512 may be formed, for example, by bending the main body portion 511 such that the lower surface thereof is protruded.

Such an embodiment can also minimize the deformation of the mounting board 510 caused by the weight of the first refrigeration unit 500A.

The provision of the reinforcing portion 512 along the longitudinal direction of the main body portion 511 can further minimize the deformation that is caused by its own weight when the first refrigeration unit 500A is drawn out of or housed into the machinery compartment 3.

Figure 9:
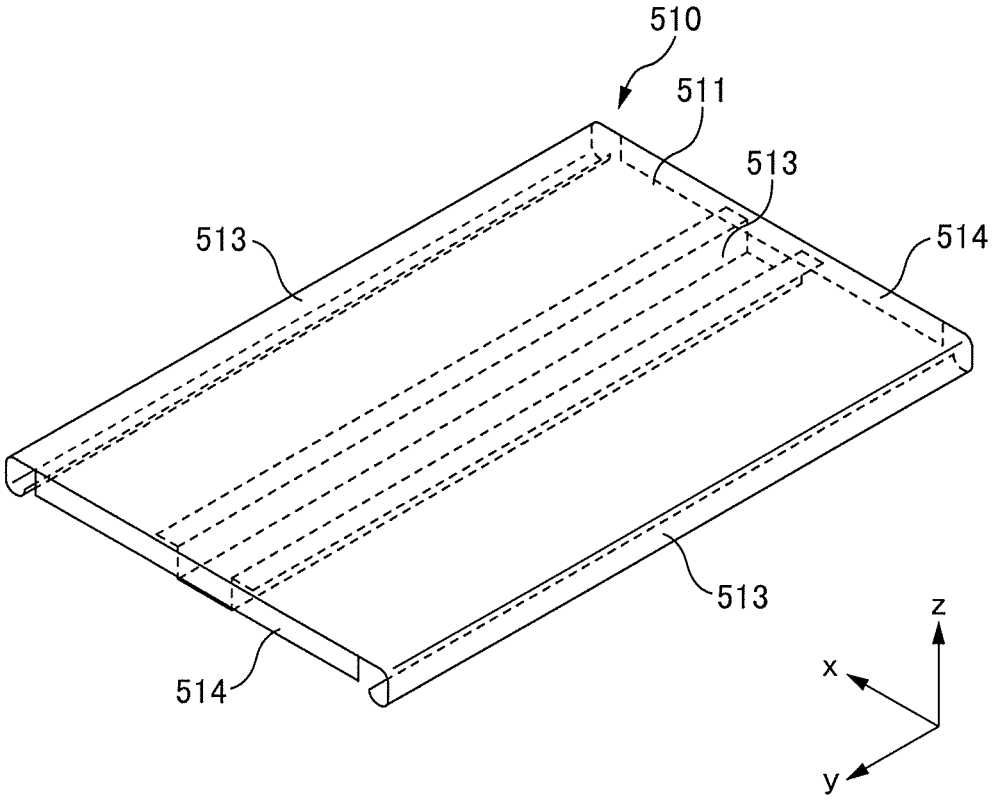
FIG. 9 is an external perspective view illustrating a mounting board for a refrigeration unit according to an embodiment of the present disclosure.

As illustrated in FIGS. 8 and 9, the main body portion 511 includes a pair of extending portions (first extending portion, second extending portion) 513 formed by folding a pair of side-edge portions toward the lower surface side along the direction (Y-axis direction) in which the first refrigeration unit 500A is drawn out. The extending portions 513 according to an embodiment of the present disclosure are formed such that, as illustrated in FIG. 9, the pair of side-edge portions along the Y-axis direction of the main body portion 511 is folded in a direction (−Z-axis direction) intersecting a surface (X-Y plane) where the components, such as the compressor 101, the condensers 102, 104, and the decompressor 108 are mounted and then end parts thereof are further folded inward.

Such an embodiment can minimize the deformation of the mounting board 510 which is caused by the weight of the first refrigeration unit 500A.

Furthermore, in an embodiment of the present disclosure, as illustrated in FIGS. 8 and 9, the main body portion 511 includes a pair of folded portions 514 formed such that a pair of side-edge portions is folded toward the lower surface side along the direction (X-axis direction) intersecting the direction (Y-axis direction) in which the first refrigeration unit 500A is drawn out.

Such an embodiment can further minimize the deformation of the mounting board 510 which is caused by the weight of the first refrigeration unit 500A.

Note that the pair of extending portions 513 may be configured not only such that the pair of side-edge portions of the main body portion 511 along the direction (Y-axis direction) in which the first refrigeration unit 500A is taken out is folded toward the lower surface side, but also such that, for example, a pair of plate-like or bar-like members is respectively mounted (for example, welded) to the pair of side-edge portions of the main body portion 511 along the direction (Y-axis direction) in which the first refrigeration unit 500A is drawn out. Such a configuration can also minimize the deformation of the mounting board 510 which is caused by the weight of the first refrigeration unit 500A.

<<<Refrigeration-Unit-Storage Rack>>>

As illustrated in FIG. 11, the first refrigeration-unit-storage rack 62A includes a pair of rail members (first rail members) 60A extending in the direction (Y-axis direction) in which the first refrigeration unit 500A is drawn out and a transverse member (first support member) 61A extending in the direction (X-axis direction) intersecting such a drawing-out direction.

Similarly, the second refrigeration-unit-storage rack 62B includes a pair of rail members (second rail members) 60B extending in the direction (Y-axis direction) in which the second refrigeration unit 500B is drawn out, and a transverse member (second support member) 61B extending in the direction (X-axis direction) intersecting such a drawing-out direction.

Note that the first refrigeration-unit-storage rack 62A and the second refrigeration-unit-storage rack 62B according to an embodiment of the present disclosure have the same shape as each other.

Thus, in the following, although a description will be made focusing on the first refrigeration-unit-storage rack 62A to avoid repetition, the same applies to the second refrigeration-unit-storage rack 62B.

The transverse member 61A is coupled (for example, welded), from below, to the end portions of the pair of the rail member 60A on the front side in the drawing-out direction of the first refrigeration unit 500A, and extends so as to traverse this drawing-out direction.

Further, the pair of rail members 60A extends in the drawing-out direction of the first refrigeration unit 500A so as to contact the pair of extending portions 513 of the mounting board 510.

Then, the first refrigeration unit 500A is housed into the first refrigeration-unit-storage rack 62A, with the pair of extending portions 513 of the mounting board 510 being supported by the pair of rail members 60A.

With such an embodiment, the first refrigeration unit 500A is housed into and drawn out of the machinery compartment 3 with a smaller force.

Figure 12:
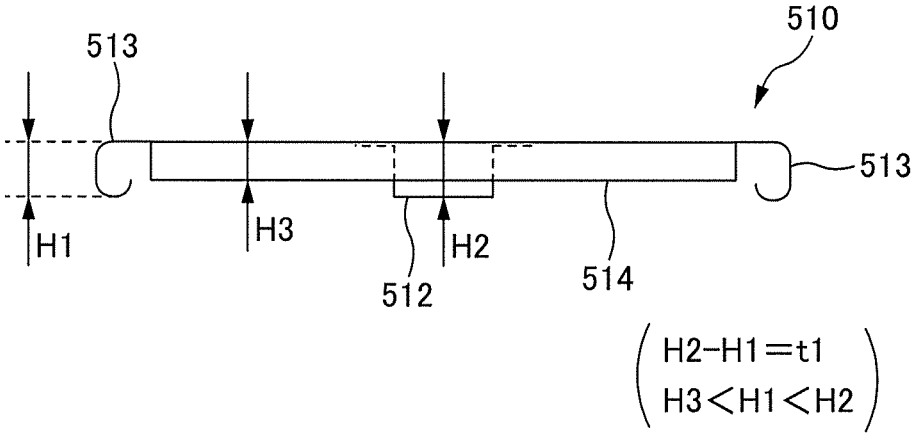
FIG. 12 is a front view illustrating a mounting board according to an embodiment of the present disclosure.

Further, as described above, the mounting board 510 includes the reinforcing portion 512, and as illustrated in FIG. 12, the height H2 of the reinforcing portion 512 is set to a height at which the reinforcing portion 512 contacts the transverse member 61A when the first refrigeration unit 500A is drawn out with the pair of extending portions 513 sliding on the pair of rail members 60A. That is, a difference (H2−H1) between the height H2 of the reinforcing portion 512 and the height H1 of the extending portions 513 is equal to or slightly smaller than the plate thickness t1 of the rail members 60A.

With such a configuration, when the first refrigeration unit 500A is drawn out from the first refrigeration-unit-storage rack 62A, the transverse member 61A contacts the reinforcing portion 512 from below, so that the weight of the first refrigeration unit 500A is partially supported by the transverse member 61A. This can minimize the deformation of the mounting board 510 which is caused by the weight of the first refrigeration unit 500A.

Note that, as in an embodiment of the present disclosure, the first refrigeration unit 500A is configured such that the components, such as the compressor 101, the condensers 102, 104, and the decompressor 108, which constitute the first refrigerant circuit 100 are mounted onto the mounting board 510. This can enhance maintainability and manufacturing workability of the ultra-low temperature freezer 1.

For example, if a part of a component, such as the compressor 101, constituting the first refrigerant circuit 100 is broken, as illustrated in FIG. 7, a pipe connection portion 501A of the first refrigeration unit 500A, where the broken component part is mounted, is demounted (for example, cut out) from a pipe on the other side connected to the heat exchanger 109, and the first refrigeration unit 500A is drawn from the first refrigeration-unit-storage rack 62A in the drawing out direction (+Y-axis direction), so that the whole first refrigeration unit 500A can be easily demounted from the machinery compartment 3. Then, a new first refrigeration unit 500A is housed in the first refrigeration-unit-storage rack 62A, and the pipe connection portion 501A is coupled (for example, welded) to the pipe on the other side, thereby being able to repair such failure in a short period of time.

Alternatively, it becomes possible to repair or replace the broken part in a state where the whole first refrigeration unit 500A where the broken part is mounted is demounted from the machinery compartment 3. This can also avoid working within the narrow machinery compartment 3.

Further, as described above, the first refrigeration unit 500A and the second refrigeration unit 500B according to an embodiment of the present disclosure have the same shape as each other, and are configured so as to be interchangeable with each other. Then, the first refrigeration-unit-storage rack 62A and the second refrigeration-unit-storage rack 62B according to an embodiment of the present disclosure also have the same shape as each other. Accordingly, the first refrigeration unit 500A and the second refrigeration unit 500B are configured so as to be capable of being housed in either of the first refrigeration-unit-storage rack 62A and the second refrigeration-unit-storage rack 62B.

Thus, it is possible to manufacture the first refrigeration unit 500A and the second refrigeration unit 500B in common as the refrigeration unit 500, in the case of both using the refrigeration unit 500 as the first refrigeration unit 500A and using it as the second refrigeration unit 500B. This can enhance manufacturing workability, thereby being able to reduce manufacturing costs by virtue of commonality of parts and manufacturing processes, and reduce spare parts inventory.

Note that the first refrigeration unit 500A and the second refrigeration unit 500B may not have the same shape as each other.

For example, the mounting board (first mounting board) 510 used for the first refrigeration unit 500A and the mounting board (second mounting board) 510 used for the second refrigeration unit 500B may not have the same shape.

Specifically, at least any of the above-described reinforcing portion 512, extending portions 513, and folded portions 514 may be formed in either one of the mounting boards 510. Alternatively, at least any of the shapes of the reinforcing portion 512, the extending portions 513, and the folded portions 514 may be different between the mounting board (first mounting board) 510 used for the first refrigeration unit 500A and the mounting board (second mounting board) 510 used for the second refrigeration unit 500B.

Further, the arrangement of the components, such as the compressor 101, the condensers 102, 104, and the decompressor 108, in the first refrigeration unit 500A and the arrangement of the components, such as the compressor 201, the condensers 202, 204, and the decompressor 208, in the second refrigeration unit 500B may not be necessarily the same.

Further, the first refrigeration-unit-storage rack 62A and the second refrigeration-unit-storage rack 62B may not have the same shape as each other.

For example, the pair of first rail members 60A used for the first refrigeration-unit-storage rack 62A and the pair of second rail members 60B used for the second refrigeration-unit-storage rack 62B may be different in width and/or thickness. Further, the transverse member (first support member) 61A used for the first refrigeration-unit-storage rack 62A and the transverse member (second support member) 61B used for the second refrigeration-unit-storage rack 62B may be different in shape. Alternatively, the transverse member 61 may be provided only either one of the first refrigeration-unit-storage rack 62A and the second refrigeration-unit-storage rack 628.

Even in such embodiments, the ultra-low temperature freezer 1 according to an embodiment of the present disclosure can achieve enhancement of maintainability and ease of manufacturing, by configuring such that the first refrigeration unit 500A and the second refrigeration unit 500B are housed in the machinery compartment 3 so as to be drawable therefrom in the horizontal direction.

Hereinabove, the ultra-low temperature freezer 1 according to an embodiment of the present disclosure has been described, however, the above embodiments of the present disclosure are simply to facilitate the understanding of the present disclosure and are not in any way to be construed as limiting the present disclosure. The present disclosure may variously be changed or altered without departing from its scope and encompass equivalents thereof.

What is claimed is:

1. An ultra-low temperature freezer comprising:

an insulated case defining a storage compartment having an opening in an upper face;

an insulated door configured to be able to open and close the opening;

a first refrigeration unit including a first mounting board on which a first compressor, a first condenser, and a first decompressor are mounted;

a second refrigeration unit including a second mounting board on which a second compressor, a second condenser, and a second decompressor are mounted;

a machinery compartment provided adjacent to the insulated case, the machinery compartment being configured to house the first refrigeration unit and the second refrigeration unit so as to be independently drawable from each other in a horizontal direction; and a control unit including a control circuit, the control unit being configured to be drawable independently of the first refrigeration unit and the second refrigeration unit, wherein:

the first refrigeration unit, the second refrigeration unit, and the control unit are housed in the machinery compartment so as to be stacked in a vertical direction, the first mounting board includes a pair of first extending portions provided to a pair of side-edge portions along a drawing-out direction of the first refrigeration unit, each of the pair of first extending portions has a first folded portion folded downward and a second folded portion further folded inward toward a center of the first mounting board, and the machinery compartment includes a pair of first rail members configured to guide the pair of first extending portions in the drawing out direction.

2. The ultra-low temperature freezer according to claim 1, further comprising:

a control-unit-mounting board where the control unit is mounted, the control-unit-mounting board being integrally configured with the control unit, wherein the control-unit-mounting board including a main body portion including a mounting hole through which the control circuit is mounted, and a reinforcing plate mounted along a lateral direction of the main body portion.

3. The ultra-low temperature freezer according to claim 1, wherein an arrangement of the first compressor, the first condenser, and the first decompressor in the first refrigeration unit is identical to an arrangement of the second compressor, the second condenser, and the second decompressor in the second refrigeration unit.

4. The ultra-low temperature freezer according to claim 1, wherein:

the second mounting board includes a pair of second extending portions provided to a pair of side-edge portions along a drawing-out direction of the second refrigeration unit, each of the pair of second extending portions has a first folded portion folded downward and a second folded portion further folded inward toward a center of the second mounting board, and the machinery compartment includes a pair of second rail members configured to guide the pair of second extending portions in the drawing-out direction.

5. The ultra-low temperature freezer according to claim 4, wherein a first reinforcing portion is formed, on a lower surface side of the first mounting board, to extend along the drawing-out direction of the first refrigeration unit.

6. The ultra-low temperature freezer according to claim 5, wherein the first reinforcing portion is a plate member that is folded along the drawing-out direction of the first refrigeration unit and mounted to a lower surface of the first mounting board.

7. The ultra-low temperature freezer according to claim 5, wherein a second reinforcing portion is formed, on a lower surface side of the second mounting board, to extend along the drawing-out direction of the second refrigeration unit.

8. The ultra-low temperature freezer according to claim 7, wherein the second reinforcing portion is a plate member that is folded along the drawing-out direction of the second refrigeration unit, and mounted to a lower surface of the second mounting board.

9. The ultra-low temperature freezer according to claim 5, wherein:

the machinery compartment includes a first support member that provides support, from below the pair of first rail member, at the first reinforcing portion when the first refrigeration unit is drawn out in the drawing-out direction and a height of the first reinforcing portion is set to a height at which the first reinforcing portion contacts the first support member when the first refrigeration unit is drawn out.

10. The ultra-low temperature freezer according to claim 9, wherein:

the machinery compartment includes a second support member that provides support, from below the pair of second rail member, at the second reinforcing portion when the second refrigeration unit is drawn out in the drawing-out direction, and a height of the second reinforcing portion is set to a height at which the second reinforcing portion contacts the second support member when the second refrigeration unit is drawn out.

11. The ultra-low temperature freezer according to claim 1, wherein each of the first folded portion and the second folded portion of the pair of first extending portions has a rounded corner.

12. The ultra-low temperature freezer according to claim 4, wherein each of the first folded portion and the second folded portion of the pair of second extending portions has a rounded corner.

13. The ultra-low temperature freezer according to claim 1, wherein each of the pair of first extending portions of the pair of first extending portions further has a third folded portion further folded upward.

14. The ultra-low temperature freezer according to claim 4, wherein each of the pair of first extending portions of the pair of second extending portions further has a third folded portion further folded upward.

15. The ultra-low temperature freezer according to claim 5, wherein a thickness of an entirety of the first reinforcing portion is greater than a thickness of an entirety of each of the pair of first extending portions.

16. The ultra-low temperature freezer according to claim 7, wherein a thickness of an entirety of the second reinforcing portion is greater than a thickness of an entirety of each of the pair of second extending portions.

17. The ultra-low temperature freezer according to claim 1, wherein the first mounting board includes a pair of folded portions provided to a front-edge portion and a rear-edge portion along a direction crossing the drawing-out direction of the first refrigeration unit, and folded downward.

18. The ultra-low temperature freezer according to claim 4, wherein the second mounting board includes a pair of folded portions provided to a front-edge portion and a rear-edge portion along a direction crossing the drawing-out direction of the second refrigeration unit, and folded downward.

19. The ultra-low temperature freezer according to claim 1, wherein the first refrigeration unit, the second refrigeration unit and the control unit are configured to be drawable at a rear side of the ultra-low temperature freezer when the insulated door is closed.

* * * * *